US007371148B2

(12) United States Patent
Marine et al.

(10) Patent No.: US 7,371,148 B2
(45) Date of Patent: May 13, 2008

(54) AUTOMATICALLY OPENING DOLLHOUSE

(75) Inventors: Jon C. Marine, Fullerton, CA (US); Debbie Glassberg, Manhattan Beach, CA (US)

(73) Assignee: Mattel, Inc., El Segundo, CA (US)

( * ) Notice: Subject to any disclaimer, the term of this patent is extended or adjusted under 35 U.S.C. 154(b) by 172 days.

(21) Appl. No.: 11/023,765

(22) Filed: Dec. 27, 2004
(Under 37 CFR 1.47)

(65) Prior Publication Data

US 2005/0287926 A1 Dec. 29, 2005

Related U.S. Application Data

(60) Provisional application No. 60/538,205, filed on Jan. 21, 2004.

(51) Int. Cl.
*A63H 3/52* (2006.01)
*A63H 3/00* (2006.01)

(52) U.S. Cl. ..... 446/476; 446/477; 446/487; 446/489

(58) Field of Classification Search ..... 446/82, 446/476, 478, 477, 487, 489
See application file for complete search history.

(56) References Cited

U.S. PATENT DOCUMENTS

| | | | | |
|---|---|---|---|---|
| 1,693,128 | A | 11/1928 | Warner | |
| 2,283,104 | A | 5/1942 | Surman | |
| 4,018,001 | A | 4/1977 | Walmer | |
| 4,139,967 | A * | 2/1979 | Kuna et al. | 446/241 |
| 4,508,519 | A | 4/1985 | Becker | |
| 4,536,162 | A | 8/1985 | Ace, Jr. et al. | |
| 4,883,443 | A * | 11/1989 | Chase | 446/478 |
| 4,905,828 | A | 3/1990 | Dods | |
| 4,941,859 | A | 7/1990 | Zaruba | |
| 5,041,044 | A | 8/1991 | Weinreich | |
| 5,120,262 | A * | 6/1992 | Caine | 446/476 |
| 5,412,297 | A * | 5/1995 | Clark et al. | 318/468 |
| 5,412,890 | A | 5/1995 | Fechter | |
| 5,435,769 | A | 7/1995 | Bertrand | |
| 5,474,173 | A | 12/1995 | Hodapp | |
| RE35,556 | E | 7/1997 | Weinreich | |
| 6,565,413 | B2 * | 5/2003 | Brownrigg | 446/476 |
| 6,773,329 | B2 * | 8/2004 | Hornsby et al. | 446/475 |

OTHER PUBLICATIONS

Photograph of "Smurf Pop-Up Sports Village" playset, Wallace Berrie, circa 1983, available at http://www.toydreamer.com.au/smurfs/pppopupspo.jpg.

Photographs of "Kelly Pop-Up Playhouse" playset, Mattel, Inc., 1999, available at: http://www.maddys-treasure.com/images/Dolls/Barbie-KellyPlayhouse.jpg and http://www.maddys-treasure.com/images/Dolls/Barbie-KellyPlayhouse-Box.jpg.

* cited by examiner

*Primary Examiner*—Kien T Nguyen
(74) *Attorney, Agent, or Firm*—Kolisch Hartwell, P.C.

(57) ABSTRACT

In one example, the disclosure includes a playset. The playset may include a middle section having a movable front face; a first side section coupled to one side of said middle section, said first side section having a movable front face; a second side section coupled to another side of said middle section, said second side section having a movable front face; and an input receiving device, where upon receiving an input, each of said movable faces of the middle, first side, and second side sections move to reveal internal units of said middle, first side, and second side sections.

16 Claims, 3 Drawing Sheets

AUTOMATICALLY OPENING DOLLHOUSE

The present application claims priority to provisional patent application Ser. No. 60/538,205, titled "AUTOMATICALLY OPENING DOLLHOUSE", filed on Jan. 21, 2004, naming Jon C. Marine, Mark S. Wittenberg and Debbie Glassberg as inventors, the entire contents of which are incorporated herein by reference for all purposes.

BACKGROUND

Examples of known prior art are found in U.S. Pat. Nos. 4,536,162, 5,041,044, and Re 35556. The disclosures of all of the patents and publications listed in this paragraph are incorporated herein by reference.

SUMMARY

The present disclosure relates generally to toy doll houses and playsets that open upon receiving an input from a user. The input can be the depression of a button on the dollhouse by a toy user, a radio signal, the presence of a figure or figurine in proximity to the house or playset, a voice command, or a specific position relative to the house or playset (e.g., proximity to a front door), or various other inputs.

Self-powered opening mat be provided via compression members retained with snaps and catches. Multiple components may open upon a single user actuation. In this way, a simple and reliable system can be achieved.

The advantages of the present disclosure will be understood more readily after a consideration of the drawings and/or the Detailed Description of Example Embodiments.

DETAILED DESCRIPTION OF EXAMPLE EMBODIMENTS

Figure 1:
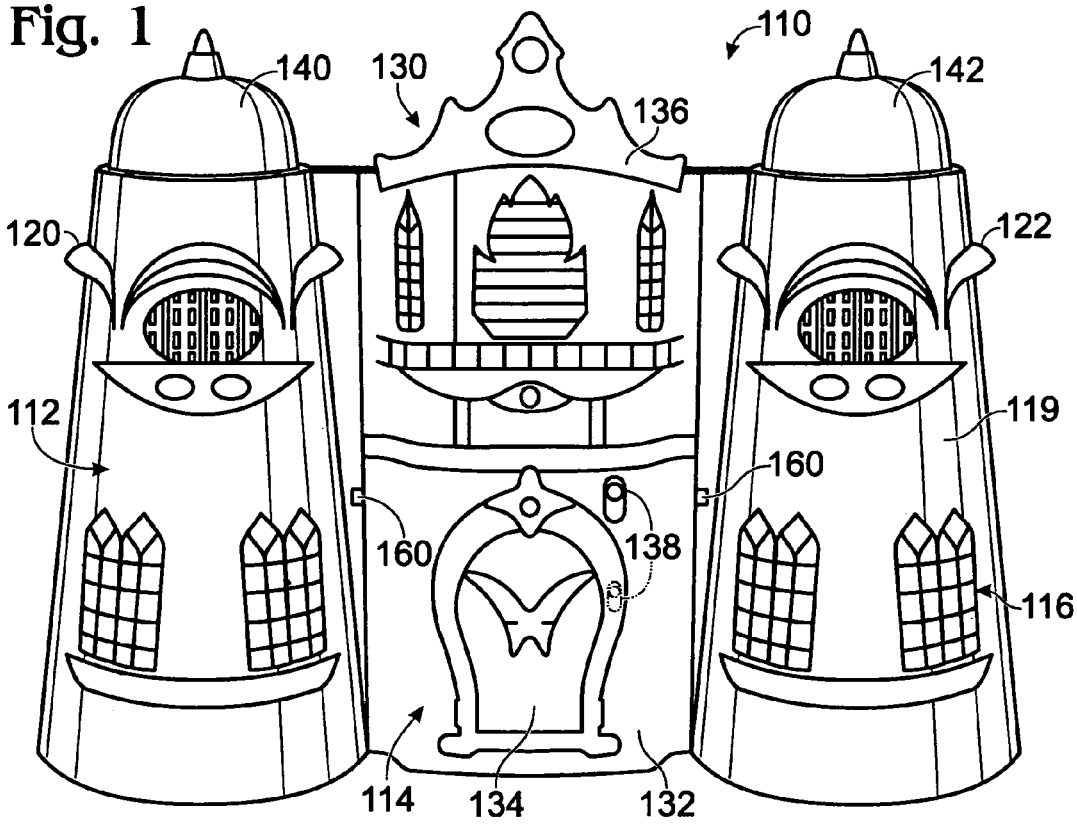
FIG. 1 is a photograph of a front of a playset in a closed position.

An example playset 110 is shown in FIG. 1 for use with three inch posable dolls (not shown). FIG. 1 shows the playset in a closed position without surface decorations; however, such decorations may be added. The dolls may be made from hard plastic.

The example playset 110 is formed of hard plastic, having three sections: a left section 112, middle section 114, and right section 116, as shown in FIG. 1. The front portions of the left and right sections (118 and 119, respectively) are circular in form to approximate left and right towers. As described in more detail below, the front portions of the left and right sections (118, 119) open to reveal interior rooms. In one example, the left tower 112 opens by rotating the front portion 118 about a pivot 120 on the outer side of the tower, so that the front portion 118 of the tower rotates outward and to the left. The right tower 116 opens in a similar way about a pivot 122 on the outer right side of the tower.

Continuing with FIG. 1, the middle, or center, section 114 is shown with an upper portion 130 and a lower portion 132, where the lower portion has a front door 134. The upper portion 130 of the middle section opens by sliding a front face 136 up vertically to reveal an interior room.

Note that in an alternative embodiment, only part (sub-portions) of the front portions of the left and/or right towers could rotatably open. Alternatively, the front portions of the left and/or right towers could be subdivided, so that there were multiple rotatably opening areas revealing different combinations or subcombinations of rooms. Further, in yet another alternative embodiment, the towers (or sub-portions thereof) could open by vertically sliding the front portions (or sub-portions thereof) up and/or down. Further, in still another alternative embodiment, the front face of the upper middle portion could open by rotating outward, or by vertically sliding downward.

The front door 134 has a first button 138 which may be located on the right edge of the door (as shown by the dashed lines). The first button (which may be a doorbell) may be located in various positions, such as on the lower portion 132 (as shown by the solid lines). Actuation of the first button 138 causes the left and right towers to automatically open, in addition to the upper portion of the middle section to slide up, and thereby reveal interior rooms. Also, actuation of the first button 138 may also cause the front door 134 to open. There is a second button located in the lower portion, near the lower right hand side of the door (not shown). The second button can be actuated by the closing of the front door, or manually by the user. Actuation of the second button causes a transformation, and is discussed in further detail below.

The front door also may have a torsional spring in the hinge shown on the left side of the door. The spring may be compressed when the door is closed, and force the door open. A linear catch may be used to hold the door in the closed position against the spring, until the first button is depressed, for example.

In one example, atop each tower is a spire (140, 142) that may be part of the front portions 118 and 199. In one example, the spires may be translucent.

In one example, sections 112 and 116 may be held in a closed position by catches 160. The catches may be actuated via depression off button 138, in one example. However, an alternate embodiment, other action by the user may cause catches 160 to move inward and release sections 112 and 116, enabling them to open.

Figure 2:
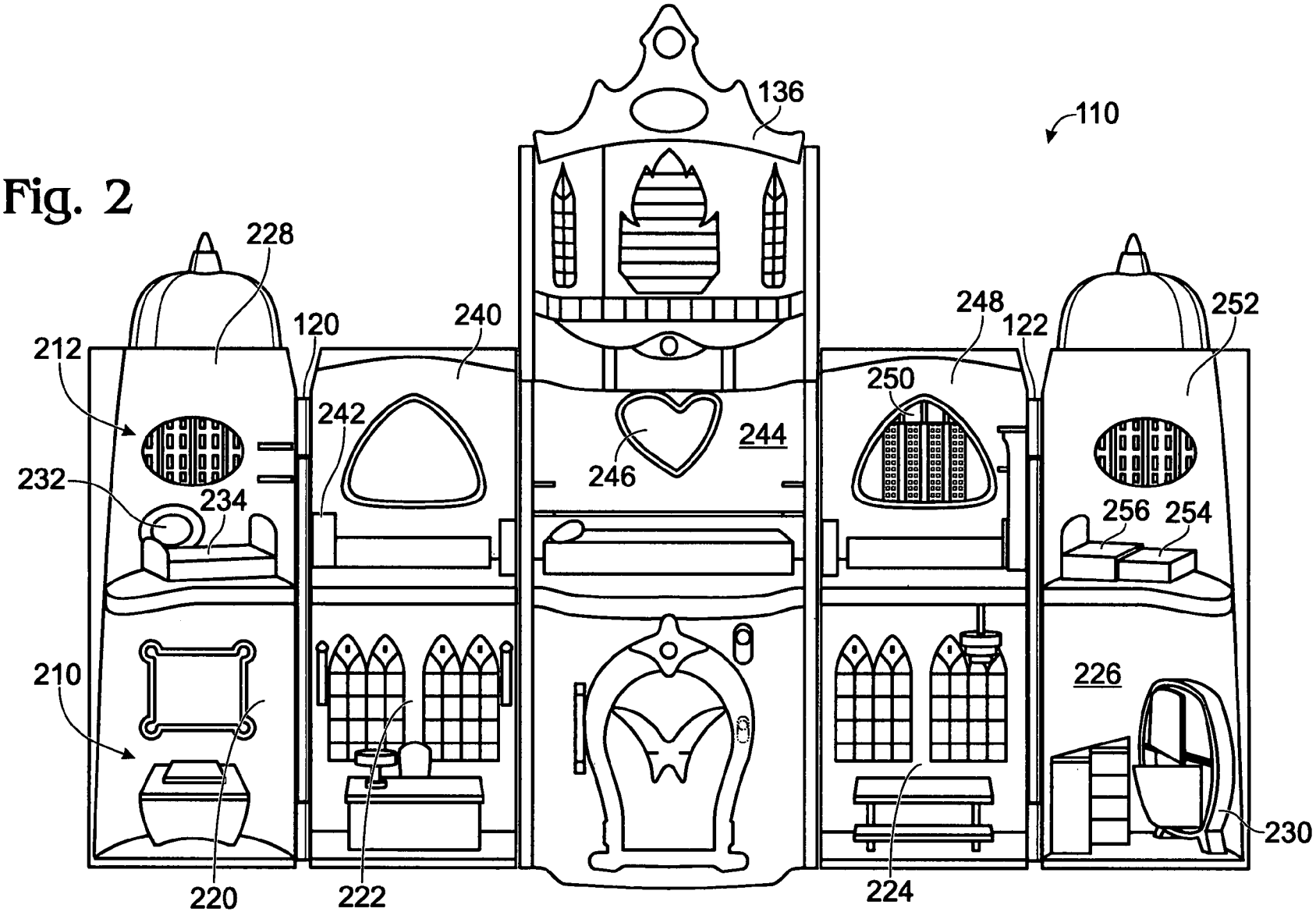
FIG. 2 is a photograph of a front of a playset in an open position.

FIG. 2 shows the playset 110 in a fully open position. In this particular example, there are two floors 210 and 212 and a series of rooms for each doll, discussed in more detail below. Each doll comes with a bedroom on the upper floors, and on the lower floors there is a library 220, school room 222, transformation room (behind front door), dining room 224, and a kitchen 226, from left to right. The kitchen 226 may have a refrigerator 230 and/or stove that open in a realistic manner. However, the interior rooms can be bedrooms, bathrooms, kitchens, dining rooms, dens, offices, meditation rooms, spas, laboratories, computer rooms, battle rooms, weapon rooms, exercise rooms, lairs, or combinations or subcombinations thereof. Further, while in this example the playset is in the form of a house, such as a castle, other forms could be used, such as, for example, a mountain, a tree, a skyscraper, a church, a farm, a factory, a train station, a hotel, a gym, or a lodge.

In this example, there are five bedrooms upstairs, each with different features. The room on the far left (228) may have a vanity 232 that has a spring loaded turning mechanism. When activated by a user, the vanity may rotate to reveal a computer screen. Also the room has a bed 234 that rotates outward to allow more space in the room than compared with the closed position.

The second room from the left (240) may have a switch 242 that makes a musical sound effect when pressed. The middle room 244 may have a mirror 246 on the back wall. In one example embodiment, when a button is pressed, the mirror (with a silver reflective film covering) is backlit by a yellow LED, causing a printed image on the back of the silver film to be revealed (not shown).

The second room from the right 248 has four moveable window shades 250 (individually, or in an alternative embodiment all four move together). The window shades 250 may move up and down to activate a switch (not shown) which initiates sound effects. The room on the far right 252 may have a bed 254 with a hard plastic bed spread 256. When the bedspread 256 is opened up by sliding, a hidden compartment may be revealed. In one example, sliding the bedspread reveals a plastic bunny that pops out of the bed via spring actuation.

FIG. 2 also shows the vertical pivots 120 and 122 between the two halves of the left and right sections. These vertical pivots may be spring loaded (via torsional springs) and damped with damping grease to actuate the front portions to be forced open upon release of a hidden linear catch, where the catch may be actuated by the front doorbell. The torsional springs can be advantageous in that the required space for them may be limited to the small vertical hinges that couple the front face to the left and right towers. In this way, it may be possible to have a simple actuation system that will reliably open, and maintain a desired appearance. However, in an alternative embodiment, the actuation can be via compression springs, coiled springs, or leaf springs.

As noted above, automatic progressive opening of the dollhouse may be achieved. In one example, when the front door bell 138 is pressed downward, the left and right towers 112 and 116 open up as well as the upper portion 136 of the center section (revealing a center room) lifts up, and (optionally) the front door (transformation room door) 134 opens.

The self-powered opening action of the towers, the upper portion of the middle section, and the front door, is relatively slow, and is advantageously achieved by using damping grease and springs to obtain continuous slow motion. In one example, the total opening time is approximately 1 second. However, the total time to open can be adjusted by varying the spring and/or damping rates, and can vary between 0 and 5 seconds, 1-5 seconds, 2-5 seconds, 2-10 seconds, or therebetween. Alternatively, a longer opening time may be used, if desired.

The opening activation may be performed from the button, with catches on snaps, in one example. In addition to the opening motion generated by depressing the doorbell, there may also be sound effects generated during and/or after the opening of the playset.

As also noted above, the transformation room behind the front door in the center section of the playset operates to move progressively, where the motion is initiated by the closing of the front door. The rotating stand behind the door that is divided into two sections (discussed further below) rotates 180 degrees to make it appear as though a figure placed in one section either disappears or is transformed into a different figure placed in the other section.

Specifically, when the front door is closed, it actuates a mechanism which rotates an internal platform 180 degrees. The internal platform (turntable) may be divided into two or more sections via an opaque wall that is affixed to dissect the internal platform. In this way, the next time the door is opened, the part of the platform that was facing the rear of the playset now faces the front, and thus it appears that there has been a "transformation."

In one example, the front door starts in an open position with no figures in the first half of the platform. Then, the closing of the front door causes the internal platform to rotate 180 degrees. When the door is again opened, it reveals a figure that was previously hidden by the opaque wall located in the second half of the platform. However, since the two halves of the platform appear substantially identical, it looks as if the figure has magically appeared. Alternatively if a first figure is placed in the first half, and a second figure was already in the second half, then opening and closing the door would make it look as if the first figure was "transformed" into the second figure. Finally, when the door is again closed, and re-opened, the starting position is shown.

The platform may include supports to retain a figure placed thereon so that it does not fall during the transformation rotation, such as foot pegs or other clamps.

In one example, the actuation of the transformation playform is provided by the release of the transformation button. In other words, depressing the button gives no response, but releasing the button actuates the turn table. The releasing action provides the motive force to rotate the platform.

In one specific example of a transformation in the transformation room, two identical figures can be used, one with wings and the other without wings. A user can first place a doll with wings (which can be referred to as a "fairy mode") on the back of turntable via an access hole in the back of the playset, discussed below with regard to FIG. 3, for example. Then, the user can place a doll with no wings (which can be referred to as a "regular mode") on the front of the turntable through an open front door. Then, when a transformation button is pressed, the turntable rotates 180 degrees, exposes the alternate figure, and it appears as if a transformation has occurred. Further, a switch may be included to provide sound effects for such a transformation. Also note that, as described above, when the front door is closed, a transformation button may also be activated, causing the turntable to turn. This multi-functional result may be achieved using the transformation button which is actuated by the closing of the front door, in one example.

Figure 3:
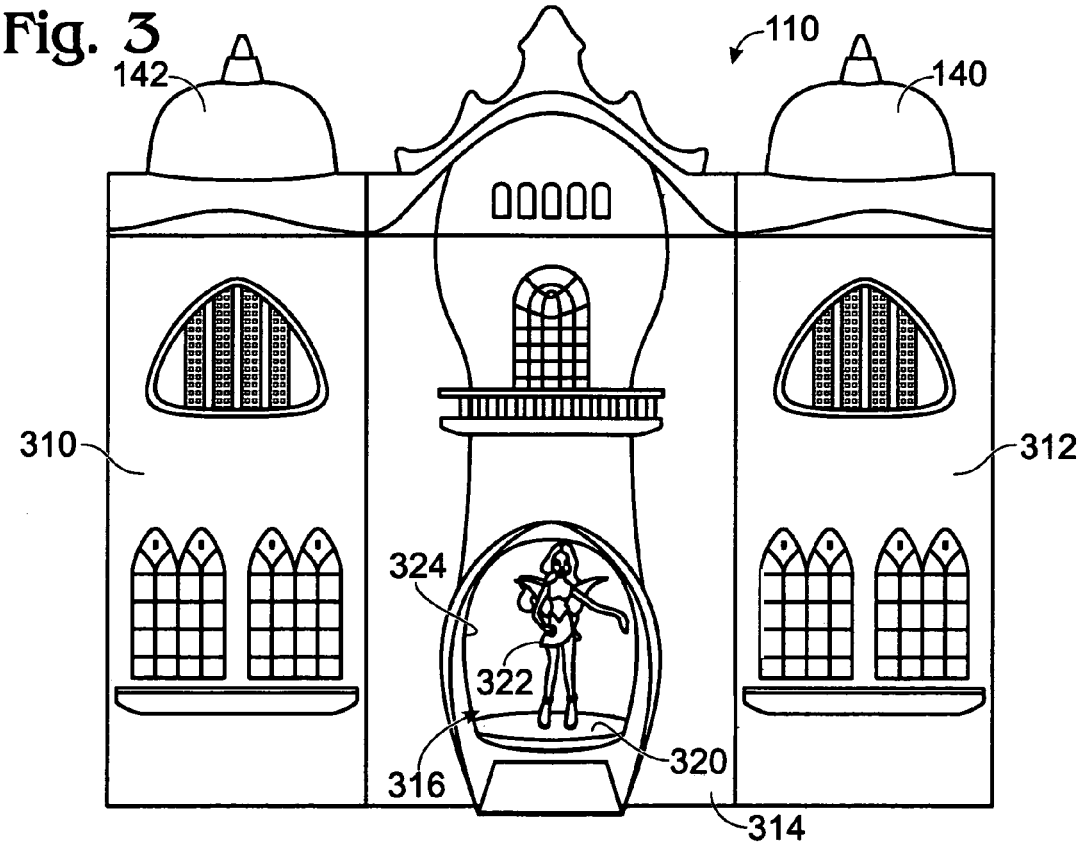
FIG. 3 shows the rear of the playset in the closed position.

FIG. 3 shows the rear of the playset 110 in the closed position. The rear faces (310 and 312) of the two towers form the back of the bedroom walls shown in FIG. 2. The rear face of the middle section 314 has an opening 316 in the lower portion to provide access to the rear half of the transformation platform 320 which reveals a figure 322 placed therein. Behind the figure is an opaque wall 324 dividing the platform 320 into two substantially similar sections.

Figure 4:
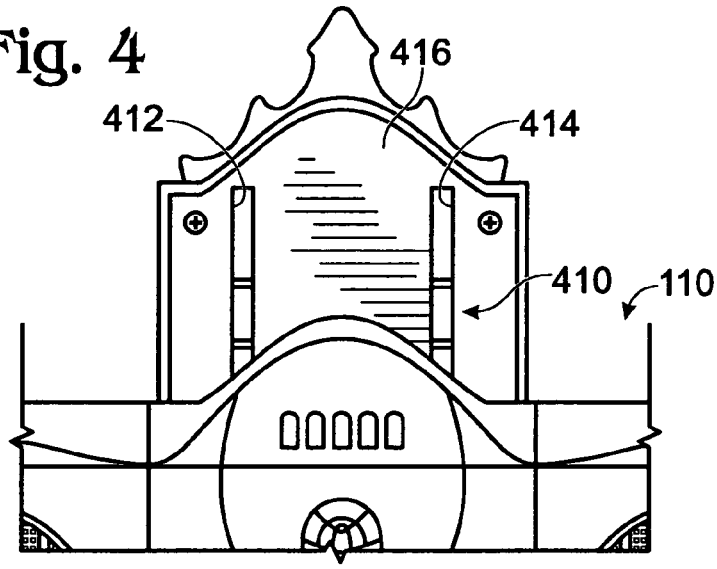
FIG. 4 shows a portion of the rear of the playset in the open position.

FIG. 4 shows a rear view of the playset 110 in an open position, and specifically shows the rear face 410 of the upper portion of the middle section in the fully open position. As shown, the rear face 410 of the upper portion of the middle section has two vertical groves 412, 414 formed by holes in the plastic backing piece 416 of the rear face of the upper portion of the middle section. As described herein, these grooves allow the internal energy storage mechanism in the upper portion 136 of the middle section to automatically move the portion 136 vertically during opening of the playset.

Figure 5:
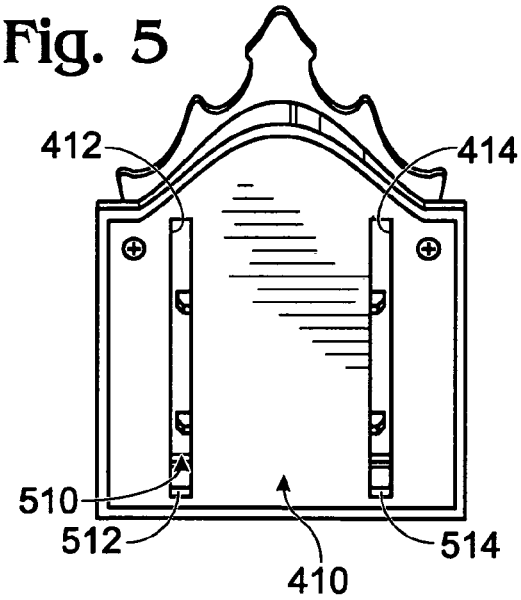
FIG. 5 shows a rear view of the front face an upper portion of a middle section of the playset in a detached state.

FIG. 5 shows another view of the rear face 410 of the upper portion of the middle section, with that section detached from the playset to show further details of the grooves 412, 414, and actuating mechanism 510 located therein. Specifically, at the bottom of the grooves, FIG. 5 shows two retaining pockets 512, 514 that snap onto mating parts of the playset, as described in more detail below with regard to FIG. 6. The two retaining pockets 512, 514 are coupled to the removable upper portion via two linear springs (not shown), including damping grease to have a desired opening motion, which may be slow or fast. However, alternative mechanisms could be used, such as torsional springs or leaf springs. The springs are compressed when the upper portion is pressed downward into the closed position. The upper portion is held in place in the closed position by a retaining snap (which can be a linear snap, or a rotating snap, for example).

Figure 6:
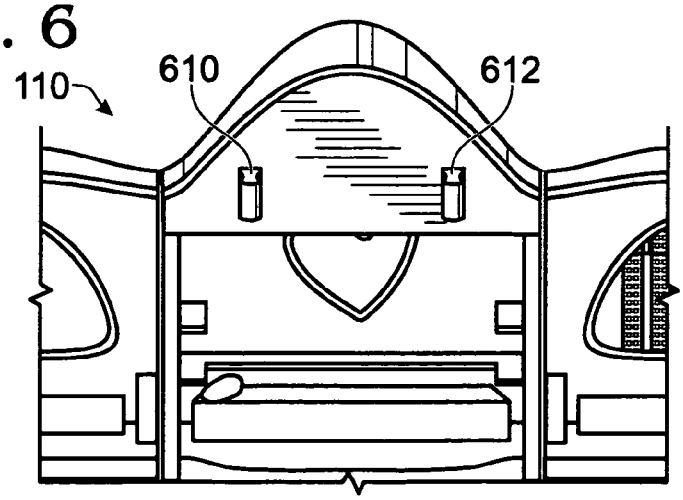
FIG. 6 shows a partial front of the upper middle area of the playset with the front face the upper portion of the middle section of the playset detached.

FIG. 6 shows a front view of the upper half of the playset 110 in the open position. Specifically, it shows the mating pegs 610, 612 which protrude into the pockets 514, 512 (respectively) in the grooves in the rear face 410 of the upper portion of the middle section, and allow it to slide vertically up and down. In this example, pegs 610 and 612 have a rectangular shape that enables a snap-fit to the pockets 514 and 512. However, other shapes could also be used.

By using compression forces with damping in this way, it may be possible to provide a simple system to allow automatic self-opening of a playset via an input from the user.

In one embodiment, directions may be included with the dollhouse in packaging that is sold to consumers. While directions may be typically thrown away, the inventors herein have recognized a new way to take advantage of directions. Specifically, in one embodiment, directions (or a portion thereof, or other informational material) may be included on a folding sheet, where a poster or other graphics are included on the back of the directions. In this way, the user can advantageously have a poster with graphics related to the toy product (such as the dollhouse, or dolls included with the dollhouse, etc.) at reduced cost, since directions are typically already included. The graphics may include trademarks or logos related to the toy product (such as the dollhouse, or dolls included with the dollhouse, etc.). In one example, the poster includes graphics of five characters related to the dollhouse, such as the characters referred to herein.

It is believed that the disclosure set forth above encompasses multiple distinct examples with independent utility. While each of these examples has been disclosed in example form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of claims in a related application. Such new claims, whether they are directed to a different invention or directed to the same invention, whether different, broader, narrower or equal in scope to the original claims, are also regarded as included within the subject matter of the inventions of the present disclosure.

We claim:

1. A playset, comprising:

a middle section having a movable front face;

a first side section coupled to one side of said middle section, said first side section having a movable front face; and a second side section coupled to another side of said middle section, said second side section having a movable front face;

a door moveably coupled to the playset, said door covering an internal area of said playset;

a rotatable platform in said internal area, said platform having a first section and a second section with a divider therebetween; and an input receiving device, whereupon receiving an input, said door opens to reveal said first section, wherein when said door is closed, said rotatable platform is actuated to rotate so that upon a subsequent opening of said door said second section is revealed.

2. The playset of claim 1 further wherein upon receiving an input, each of said movable faces of the middle, first side, and second side sections move to reveal internal units of said middle, first side, and second side sections.

3. The playset of claim 1 wherein said input receiving device is positioned in a location where a front doorbell would be positioned.

4. The playset of claim 1 wherein said input receiving device is a button to be actuated by a user of the playset.

5. The playset of claim 1 wherein said playset represents a house.

6. The playset of claim 1, further wherein when the input receiving device receives an input, one or more of the movable front faces move to reveal an internal unit of one or more of said middle, first side, and second side sections.

7. The playset of claim 6, wherein said movement of one or more of said middle, first side, and second side sections is self powered.

8. The playset of claim 7, wherein said self-powered movement is provided via compression members retained with snaps and catches.

9. The playset of claim 7, wherein said self-powered movement of said first and second side sections is provided via torsional springs in first and second hinges respectively coupling said first and second side sections to said middle section.

10. The playset of claim 7, wherein said self-powered movement includes self-powered opening.

11. The playset of claim 7, wherein said self-powered movement is provided at least in part by compressed members that are compressed when one or more of said middle, first side, and second side sections are in a closed position.

12. The playset of claim 1, wherein said moveable faces of said side sections rotate to open.

13. The playset of claim 1, wherein said moveable face of said middle section slides to open.

14. The playset of claim 1, wherein during said opening, sound is generated from the playset.

15. The playset of claim 1, wherein said input is at least one of an electronic signal, button, radio frequency signal, electromagnetic signal, and voice command.

16. A playset, comprising:

a middle section having a movable front face;

a first side section coupled to one side of said middle section, said first side section having a movable front face;

a second side section coupled to another side of said middle section, said second side section having a movable front face;

a door moveably coupled to the playset, said door covering an internal area of said playset;

a rotatable platform in said internal area, said platform having a first section and a second section with an opaque divider therebetween; and an input receiving device, where upon receiving an input:

said door opens to reveal said first section, wherein when said door is closed, said rotatable platform is actuated to rotate so that upon a subsequent opening of said door said second section is revealed, and each of said movable faces of the middle, first side, and second side sections move to reveal internal units of said middle, first side, and second side sections.

* * * * *